US007470041B2

(12) United States Patent
Higgins et al.

(10) Patent No.: US 7,470,041 B2
(45) Date of Patent: Dec. 30, 2008

(54) LIGHT FIXTURE

(76) Inventors: Mark Higgins, 5928 Beltway Loop, Lacey, WA (US) 98513; Vivian Hurd, 2921 E. Harstine Island Rd. North, Shelton, WA (US) 98584-9464

( * ) Notice: Subject to any disclaimer, the term of this patent is extended or adjusted under 35 U.S.C. 154(b) by 115 days.

(21) Appl. No.: 11/487,530

(22) Filed: Jul. 14, 2006

(65) Prior Publication Data

US 2008/0013327 A1 Jan. 17, 2008

(51) Int. Cl.
*F21V 21/26* (2006.01)

(52) U.S. Cl. ..... 362/269; 362/287; 362/368; 362/371

(58) Field of Classification Search ..... 362/647, 362/649, 371, 364–365, 404, 410, 418–419; 439/6, 8

See application file for complete search history.

(56) References Cited

U.S. PATENT DOCUMENTS 2,118,785 A * 5/1938 Birdseye et al. ..... 439/6
2,908,811 A * 10/1959 Duddy ..... 362/388
4,232,361 A * 11/1980 Kelsall ..... 362/364
4,638,970 A 1/1987 Phelan
4,974,134 A * 11/1990 Bourne ..... 362/286
4,984,139 A * 1/1991 Goggia ..... 362/153.1
5,003,441 A * 3/1991 Crowe et al. ..... 362/183
5,428,515 A * 6/1995 Jung ..... 362/640
5,887,966 A * 3/1999 Eissner et al. ..... 362/153.1
6,022,129 A * 2/2000 Tang ..... 362/404
6,234,653 B1 * 5/2001 Karton ..... 362/408
6,764,204 B1 * 7/2004 Peters ..... 362/429
6,863,573 B1 * 3/2005 Kohler ..... 439/646
2006/0013009 A1 1/2006 Falco, Jr.

* cited by examiner

*Primary Examiner*—Ali Alavi
(74) *Attorney, Agent, or Firm*—James Ray & Assoc.

(57) ABSTRACT

A light fixture removably attachable to a stationary socket includes a lamp socket mounted for receiving a lamp and a connector which is electrically engageable with such stationary socket. The connector is attached in spaced relationship to the lamp socket and is electrically connected thereto. The light fixture may include a housing having the lamp socket mounted therein with the connector attached to the housing in one of a rigid, hinged and swivel manner. The light fixture is advantageous for converting a unidirectional recessed light fixture into a multidirectional light fixture.

18 Claims, 2 Drawing Sheets

LIGHT FIXTURE

FIELD OF THE INVENTION

The present invention relates, in general, to light fixtures and, more particularly, this invention relates to a light fixture which converts a unidirectional recessed light fixture into a multidirectional light source.

BACKGROUND OF THE INVENTION

One problem commonly experienced with recessed lighting fixtures is the fixed unidirectional nature of the generated light. Accordingly, location of each recessed light fixture must be carefully planned for in order to provide sufficient light coverage over the entire area.

Therefore, many individuals prefer track lighting when the lighting pattern must be changed due to a different furniture layout and/or due to a desire to highlight a displayed prized possession. Such prized possessions may include pottery, paintings, collectibles, trophies and the like. However, track lighting is often difficult and expensive to install.

SUMMARY OF THE INVENTION

According to one embodiment, the present invention provides a light fixture attached to a stationary socket in a removable manner. Such light fixture includes a lamp socket for receiving a lamp therein. A releasable electrical connector is electrically engageable with such stationary socket. The connector is attached in spaced relationship to the lamp socket and is electrically connected thereto.

According to another embodiment of the invention, there is provided a method of converting a unidirectional light fixture which is mounted in a recessed manner in relationship to a generally flat surface into an adjustably multidirectional light fixture. The method includes the steps of coupling an electrical connector to a lamp socket mounted within the recessed light fixture. Then, rigidly connecting one end of an elongated member to the electrical connector, wherein a length of the elongated member is predetermined to dispose an axially opposed end thereof at a predetermined distance beyond the generally flat surface. Attaching one of a swivel and a hinge joint member to the protruding opposed end of the elongated member. Thereafter, attaching a lamp socket to the one of the swivel and the hinge joint means and electrically connecting the lamp socket to the electrical connector.

OBJECTS OF THE INVENTION

It is, therefore, one of the primary objects of the present invention to provide a device which converts a unidirectional recessed light fixture into a multidirectional light fixture.

Another object of the present invention is to provide a recessed light conversion device which can be threadedly connected to a stationary socket of the recessed light fixture.

Yet another object of the present invention is to provide recessed light conversion device which incorporates a cover for covering the open end of the recessed light fixture.

A further object of the present invention is to provide a recessed light conversion device which is usable with incandescent and halogen lamps.

Yet a further object of the present invention is to provide a recessed light conversion device which employs a swivel joint.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
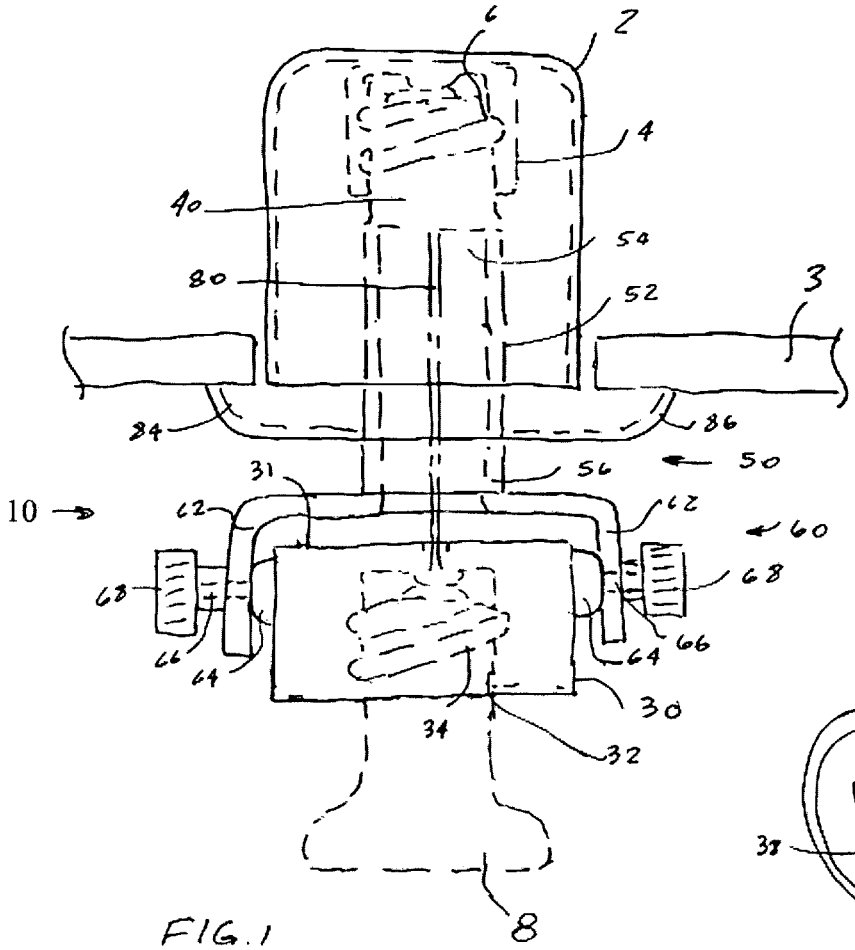
FIG. 1 is an elevation view of a light fixture constructed in accordance with one embodiment of the invention.

Prior to proceeding to the more detailed description of the present invention, it should be noted that, for the sake of clarity and understanding, identical components which have identical functions have been identified with identical reference numerals throughout the several views illustrated in the drawing figures.

Figure 2:
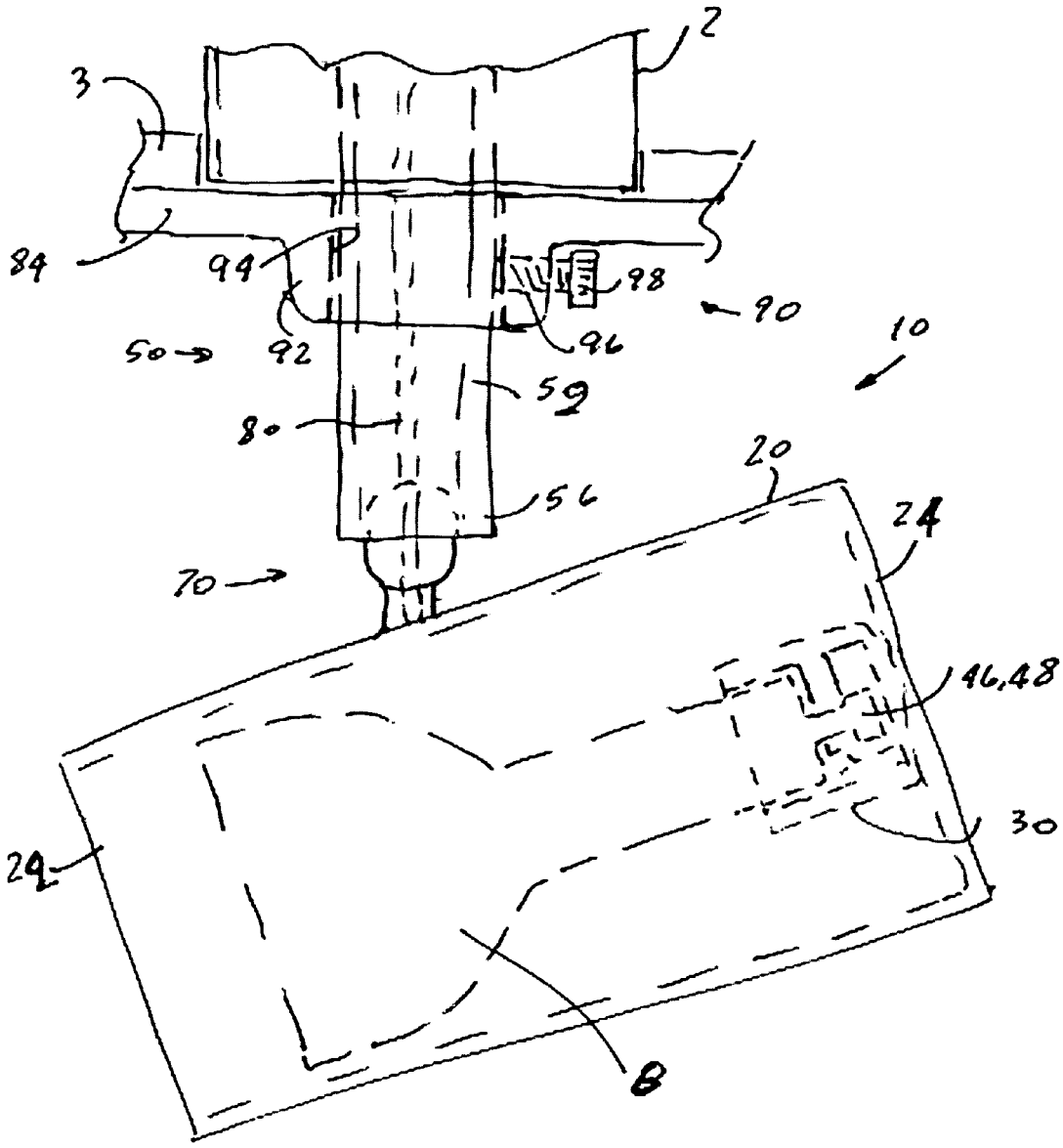
FIG. 2 is an elevation view of a light fixture constructed in accordance with another embodiment of the invention.

Reference is now made, to FIGS. 1-4, wherein there is shown a light fixture, generally designated 10, which is attachable to a stationary socket 4 in a removable manner. Light fixture 10 preferably includes a housing 20 which has a first open end 22 and an opposed second closed end 24. The housing 20 may have a substantially cylindrical shape, as shown in FIG. 2, and can be manufactured from a metallic or plastic material.

A lamp socket 30 is mounted within the housing 20 adjacent the second closed end 24 thereof for receiving a lamp 8. A connector means 40 is electrically engageable with such stationary socket 2.

The light fixture 10 further includes an attachment means, generally designated 50, for attaching the connector means 40 in spaced relationship to the housing 20 or to the lamp socket 30.

According to one embodiment of the invention, the attachment means 50 includes an elongated member 52 having a first end 54 which is rigidly connected to the connector means 40 and having a second end 56 which is rigidly connected to the housing 20 by any well known attachment methods including but not limited to welding, brazing, fastening, and adhesive. The elongated member 52 may be formed integral to the housing 20 or to the lamp socket 30, for example, by a molding or by a stamping process.

According to another embodiment of the invention, the attachment means 50 includes the elongated member 52 having a first end 54 being rigidly connected to the connector means 40 and a hinge means, generally designated 60, for connecting the second end 56 of the elongated member 52 to the housing 20 in a hinged manner. Exemplary hinge means 60 of FIG. 1 may include bifurcated portions 62 of the second end 56 and a pair of projections 64 radially formed on the outer surface of the housing 20 each engaging a respective one of the pair of bifurcated portions 62. Each projection 64 may be adapted with a threaded stem 66 for securing the light fixture 10 in a preselected position by a pair of threaded nuts 68.

Although, the hinge means 60 is shown as being attached to the outer side surface of lamp socket 30, it will be apparent to those skilled in the art that the hinge means 60 may be attached to the closed end 31 of the lamp socket 30. Furthermore, any other well known hinged connection arrangement may be utilized in the present invention. It will be understood that although the hinge means 60 is illustrated as being attached directly to socket 30, it will be apparent to those skilled in the art that hinge means 60 may be similarly attached to the housing 20.

Now in particular reference to FIG. 2, attachment means 50, of the presently preferred embodiment of the invention, includes an elongated member 52 having a first end 54 rigidly connected to connector means 40 and a swivel joint means, generally designated 70, connecting the second end 56 of the elongated member 50 to the lamp socket 30 or to the housing 20. The swivel joint means 70 may be attached to one of the side surface and the second closed end 24 of the housing 20. It will be understood that the swivel joint means 70 may be attached directly to the lamp socket 30.

A wiring means 80 electrically connects the lamp socket 30 to the connector means 50. A presently preferred wiring means 80 includes a plurality of simple wires 82. Preferably, the elongated member 52 is formed as a generally hollow member to provide a passage for such plurality of wires 82. It will be appreciated that a tubular shape of the elongated member 52 will be most advantageous in the present invention.

The present invention contemplates that the light fixture 10 is connectable with the stationary socket 4 presently in use either for threadedly receiving a conventional Addison type incandescent light bulb or for insertion of a halogen type lamp 8.

The operation of the light fixture 10, of the present invention, is illustrated in combination with a light assembly 2 which is mounted in a recessed manner in relationship to a generally flat surface 3. It will be appreciated that such light assembly 2 is commonly used in combination with the flat surface 3 such as a ceiling. More particularly, the operation of the light fixture 10 of the present invention is illustrated as a methodology for converting a unidirectional recessed light assembly 2 into a multi-directional light assembly. In order to achieve such conversion, the connector means 40 is mechanically and electrically coupled to the lamp socket 4 mounted within the recessed light assembly 2. The length of the elongated member 52 rigidly connected to the connector means 40 is predetermined to enable a free second end 56 thereof to protrude a predetermined distance from the generally flat ceiling surface 3. The distance is generally based on a specific environment in which the light fixture 10 will be used. The hinge means 60 or the swivel joint means 70 is attached to the second end 56 of the elongated member 52 and is further attached to the lamp socket 30 or to the housing 20 having such lamp socket 30 disposed therein.

Since the lamp socket 30 is electrically connected to the connector means 40, it receives the electrical energy from the stationary socket 4. The user may than manually position the light fixture 10 in the predetermined direction and repetitively change the direction when a particular need arises.

When the recessed light assembly 2 includes the stationary socket 4 having a generally helical thread 6 formed on an inner wall surface thereof, the connector means 40 is provided with a generally helical thread 42 formed on an outer surface thereof for engagement with such stationary socket 4. Preferably, lamp socket 30 is provided with a generally helical thread 34 formed on an inner wall surface 32 thereof for receiving the lamp 8 used in combination with the recessed light assembly 2.

When such stationary socket 4 includes a pair of insert grooves (not shown) and a pair of electrical terminals (not shown) each positioned within a respective one of such pair of grooves (not shown), the connector means 40 will include upwardly protruding plus and minus insert lugs 46 and 48 respectively which are received by the pair of groves (not shown) and further received in abutment with the pair of terminals (not shown).

Figure 4:
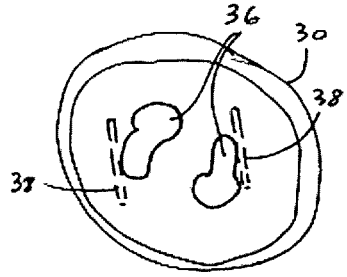
FIG. 4 is a plan view of the lamp socket according to one embodiment of the present invention.
Figure 3A:
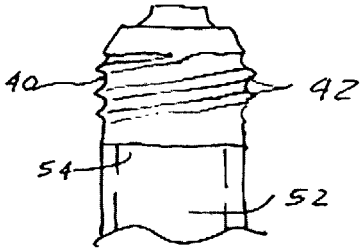
FIGS. 3*a*-3*b* is a partial elevation view of the connector for mounting the light fixture of the present invention to a stationary socket.
Figure 3B:
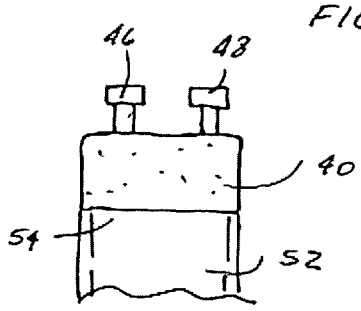

Accordingly, the lamp socket 30, as best shown in FIG. 4, will be provided with a complimentary pair of insert grooves 36 and a pair of electrical terminals 38 each positioned within a respective one of such pair of grooves 36 for receiving a halogen type lamp 8. It will be apparent to those skilled in the art that although the connector means 40 of FIG. 3 and the socket 30 of FIG. 4 provide for a rotatable locking connection between such connector means 40 and the socket 30 a simple insertion type connector means 40 and the socket 30 will be employable in the present invention.

The light fixture 10 of the present invention may include an optional cover plate 84 which is attached to the attachment means 50 and, more particularly, to the elongated member 52 in one of a semi-permanent and permanent manner. It will be appreciated that the cover plate 84 is positioned at a predetermined distance from the connector means 40 for further positioning in close proximity to such generally flat ceiling surface 3 in order to cover an aperture which is formed in the ceiling 3 and which is disposed adjacent the open end of the light assembly 2. The cover plate 84 may be formed as a disk like member or may be provided with an annular flange 86 of a predetermined shape as best shown in FIG. 1.

When the cover plate 84 is attached in a semi-permanent manner, it may be provided with a mounting means, generally designated 90, for adjusting a position of the cover plate 84 in relationship to the generally flat ceiling surface 3. Such adjustment is advantageous to use the light fixture 10 of the present invention with the recessed light assemblies 2 having different lengths.

By way of example of FIG. 2, such mounting means 90 includes an abutment 92 formed on the outer surface of the cover plate 84, an aperture 94 axially formed within the abutment 92 for receiving the elongated member 52, a threaded aperture 96 formed within the abutment 92 and having an axis thereof disposed perpendicular to a longitudinal axis of the aperture 94 and a threaded member 98 which is mounted within the threaded aperture 96 and which is manually operable for frictionally engaging an other surface of the elongated member 52 received within the aperture 94. Alternatively, the cover plate 84 is provided with a simple aperture 94 and may be fastened directly to the ceiling 3.

Although the present invention has been shown in terms of the light fixture 10 being attachable to a recessed light assembly 2, it will be apparent to those skilled in the art, that the present invention may be applied to other light assemblies. For example, the light fixture 10 may be coupled to a table or a floor light assembly.

It will be also apparent to those skilled in the art, that the light fixture 10 is suitable for use under present voltages and with various intensities of the lamp 8 by selecting appropriate wiring and socket and connector constructions.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A light fixture attachable to a stationary socket in a removable manner, said light fixture comprising:

(a) a lamp socket for receiving a lamp therein;

(b) a connector electrically engageable with such stationary socket in a releasable manner;

(c) an attachment means engageable with each of said connector and said lamp socket for attaching said connector in a spaced relationship to said lamp socket, said attachment including a hollow elongated member having a first end thereof rigidly connected to said connector and having an opposed second end thereof positioned in closed proximity to one end of said lamp socket, said attachment means further including a hinge means for connecting said second end of said elongated member in a hinged manner to one of said lamp socket and a housing having said lamp socket mounted therein, wherein said lamp socket is positioned in a spaced relationship to such stationary socket; and (d) a wiring means for electrically connecting said lamp socket to said connector, wherein said wiring means includes a plurality of electrical wires routed internal through said hollow elongated member and generally hidden from direct view.

2. The light fixture, according to claim 1, wherein said light fixture includes said housing having said lamp socket mounted therein.

3. The light fixture, according to claim 1, wherein said lamp socket includes a generally helical thread formed on an inner wall surface thereof.

4. The light fixture, according to claim 1, wherein said light fixture includes a cover attached to said elongated member in one of a semi-permanent and permanent manner.

5. The light fixture, according to claim 4, wherein such stationary socket is mounted within a recessed light fixture and said cover plate is disposed a predetermined distance from said connector for covering an open end of such recessed light fixture.

6. The light fixture, according to claim 1, wherein such stationary socket includes a generally helical thread formed on an inner wall surface thereof.

7. The light fixture, according to claim 6, wherein said connector includes a generally helical thread formed on an outer surface thereof for mating engagement with such generally helical thread of such stationary socket.

8. The light fixture, according to claim 1, wherein such stationary socket includes a pair of insert grooves and a pair of electrical terminals each positioned within a respective one of such pair of grooves and said connector includes upwardly protruding plus and minus insert lugs received by such pair of grooves in abutment with such pair of terminals.

9. A method of converting a unidirectional light fixture mounted in a recessed manner in relationship to a generally flat surface into an adjustably multidirectional light fixture, said method comprising the steps of:

(a) coupling an electrical connector to a lamp socket mounted within said recessed light fixture;

(b) rigidly connecting one end of an elongated hollow member to said electrical connector, (c) positioning an axially opposed end of said elongated hollow member at a predetermined distance external to said generally flat surface;

(d) attaching one of a swivel and a hinged joint means to said protruding opposed end of said elongated hollow member;

(e) attaching a lamp socket to said one of said swivel and said hinge joint means; and (f) electrically connecting, by way of at least one wire routed internal through said hollow elongated member and generally hidden from direct view, said lamp socket to said electrical connector.

10. A light fixture removably attachable to a stationary socket mounted within a recessed light fixture, said light fixture comprising:

(a) a lamp socket for operatively receiving a lamp therein;

(b) a connector electrically engageable with such stationary socket in a releasable manner;

(c) a hollow elongated member engageable with each of said connector and said lamp socket for attaching said connector in a spaced relationship to said lamp socket;

(d) a cover disposed a predetermined distance from said connector for covering an open end of such recessed light fixture;

(e) a mounting means for adjustably attaching said cover to a predetermined portion of said hollow elongated member, said mounting means includes an abutment formed on a surface of said cover plate, an aperture axially formed through said abutment and said cover plate for receiving said hollow elongated member, a threaded aperture formed within said abutment and having a longitudinal axis disposed perpendicular to a longitudinal axis of said aperture and a threaded member mounted within said threaded aperture and manually operable for frictionally engaging said hollow elongated member received within said aperture; and (f) a wiring means for electrically connecting said lamp socket to said connector.

11. The light fixture, according to claim 10, wherein said cover is disposed intermediate said connector and said lamp socket.

12. A light fixture removably attachable to a stationary socket having a pair of insert grooves and a pair of electrical terminals each positioned within a respective one of such pair of grooves, said light fixture comprising:

(a) a lamp socket for receiving a lamp therein;

(b) a connector having upwardly protruding plus and minus insert lugs releaseably received by such pair of grooves in abutment with such pair of terminals;

(c) an attachment means engageable with each of said connector and said lamp socket for attaching said connector in a spaced relationship to said lamp socket; and (d) a wiring means for electrically connecting said lamp socket to said connector.

13. A light fixture removably attachable to a stationary socket mounted in a recessed manner relative to a surface, said light fixture comprising:

(a) a lamp socket for operatively receiving a lamp therein;

(b) an electrical connector electrically releasably engageable with such stationary socket;

(c) a hollow elongated member having a first open end thereof rigidly connected to said connector and having a predetermined length to position an opposed second open end thereof at a predetermined distance external to such surface and in closed proximity to one end of said lamp socket;

(d) a hinge means for connecting said second open end of said elongated member in a hinged manner to one of said lamp socket and a housing having said lamp socket mounted therein; and (e) a plurality of electrical wires routed internal through said hollow elongated member, each of said plurality of electrical wires having a first end thereof operatively secured to said electrical connector and having an opposed second end thereof operatively secured to said lamp socket, said opposed second end of said each electrical wire exiting through said opposed second open end of said hollow elongated member and through a portion of said hinge means.

14. A light fixture removably attachable to a stationary socket having a generally helical thread formed on an inner wall surface thereof, said light fixture comprising:

(a) a housing having a first open end and an opposed second closed end;

(b) a lamp socket having a generally helical thread formed on an inner wall surface thereof, said socket mounted within said housing adjacent said second closed end thereof for threadedly receiving a threaded end of a lamp;

(c) a connector having a generally helical thread formed on an outer surface thereof for mating and operable engagement with such stationary socket;

(d) a hollow elongated member rigidly attached to and positioned about a common longitudinal axis with said connector;

(e) a swivel joint member adjustably connecting a free end of said hollow elongated member to said housing; and (f) a wiring means for electrically connecting said lamp socket to said connector, wherein said wiring means includes a plurality of electrical wires routed internal through said hollow elongated member and generally hidden from direct view.

15. The light fixture, according to claim 14, wherein said light fixture includes a cover plate rigidly attached to said hollow elongated member.

16. The light fixture, according to claim 14, wherein said swivel joint member is attached to one of a side surface and said closed end of said housing.

17. The light fixture, according to claim 14, wherein said light fixture includes a cover plate and a mounting means for adjustably attaching said cover plate to a predetermined portion of said hollow elongated member.

18. The light fixture, according to claim 17, wherein said mounting means includes an abutment formed on a surface of said cover plate, an aperture axially formed through said abutment and said cover plate for receiving said hollow elongated member, a threaded aperture formed within said abutment and having a longitudinal axis disposed perpendicular to a longitudinal axis of said aperture and a threaded member mounted within said threaded aperture and manually operable for frictionally engaging said hollow elongated member received within said aperture.

* * * * *